United States Patent [19]

Dutro

[11] 4,216,877

[45] Aug. 12, 1980

[54] VENDOR FOR FLAT ARTICLES AND METHOD OF VENDING SAID ARTICLES

[76] Inventor: Lyle V. Dutro, 1908 Meadowbrook, Altadena, Calif. 91001

[21] Appl. No.: 864,773

[22] Filed: Dec. 27, 1977

[51] Int. Cl.[2] ..... B65H 5/16

[52] U.S. Cl. ..... 221/213; 271/18.3; 221/1

[58] Field of Search ..... 221/1, 213, 214, 227, 221/231, 232, 236, 238, 215, 225, 210, 211, 226, 230; 271/18.3, 21, 22

[56] References Cited

U.S. PATENT DOCUMENTS

| | | | |
|---|---|---|---|
| 3,114,475 | 12/1963 | Etes | 221/215 X |
| 3,263,859 | 8/1966 | Searle | 221/227 |
| 3,940,125 | 2/1976 | Morton | 271/18.3 |

*Primary Examiner*—Stanley H. Tollberg

*Attorney, Agent, or Firm*—Donald D. Mon

[57] ABSTRACT

A vendor for dispensing a single article at a time from a stack of flat articles such as papers or magazines. The vendor has a separator to separate at least an edge of the top article from the stack, and a conveyor insertable beneath the separated article to convey the separated top article away from the stack. A presser can optionally be provided to press against the separated top article and hold it to the conveyor means while the article is being dispensed. A coin operated release is provided to prevent operation of the device except after some prerequisite condition has been met, for example the insertion of a predetermined number of coins. The invention contemplates the method of lifting the edge, inserting the conveyor underneath it, and issuing the article on the conveyor. Optionally the presser can hold the article firmly to the conveyor to assist the operation.

27 Claims, 11 Drawing Figures

VENDOR FOR FLAT ARTICLES AND METHOD OF VENDING SAID ARTICLES

This invention relates to vendors for dispensing, one at a time, single articles from a stack of such articles, and to a method for vending said articles.

The problems of economically dispensing newspapers and magazines have become increasingly serious as the cost of these articles has risen. There was a day when their cost was low enough that people would not bother to pilfer them, of if they did the economic loss was tolerable. However, that is no longer the situation, and the use of more reliable vending means has become necessary. There are known devices where insertion of the proper number of coins gives access to a stack of articles. The customer is relied on to take only one. This is proving to be a less reliable assumption as the cost of the articles has increased. Accordingly, there is now a serious requirement for a device which will without supervision reliably dispense only one article at a time, and not give access to the stack.

There have been vending devices for the purpose of feeding or vending articles one at a time and one such device is shown in Dutro U.S. Pat. No. 3,934,754, issued Jan. 27, 1976, entitled "Device for Issuing Single Units of Flat Flexible Articles". Also, there is in the printing art a class of device known as a "feeder" wherein an end member is peeled from a stack. Such a feeder is shown in Dutro U.S. Pat. No. 3,384,366, issued May 21, 1968, entitled "Outfeed Mechanism".

Both of the foregoing devices, while effective, still have limitations by way of complicated structure, excessive length of travel path of the article being dispensed, and uncertainty of delivery.

It is an object of this invention to provide a vendor which fully encloses a stack of articles to be dispensed one at a time, which cannot be operated until after predetermined coinage has been provided, and which will reliably dispense one article at a time along a simple, minimum-length straight path without mussing or disarranging the article.

It is another object of this invention to provide a machine which without requiring adjustment for the purpose can dispense articles of a range of thicknesses, and can even dispense individual items of intermixed different thicknesses.

A vendor according to this invention includes an enclosure adapted to enclose a stack of articles to be dispensed one at a time. The articles are supported on a platform whose elevation can be raised to a dispensing level. The device includes separator means to separate at least an edge of the top article from the stack, and conveyor means which is insertable under the separated article, to convey said article off of the stack.

A preferred but optional feature of this invention resides in presser means to press the article against the conveyor and cause the article to be issued from the vendor with a positive grip on the article.

The invention also comprehends the method of lifting the edge, inserting the conveyor means, optionally pressing the article against the conveyor means, and moving the conveyor means and presser means (if provided) to issue the article.

This invention will be fully understood from the following detailed description and the accompanying drawings, in which.

Figure 1:
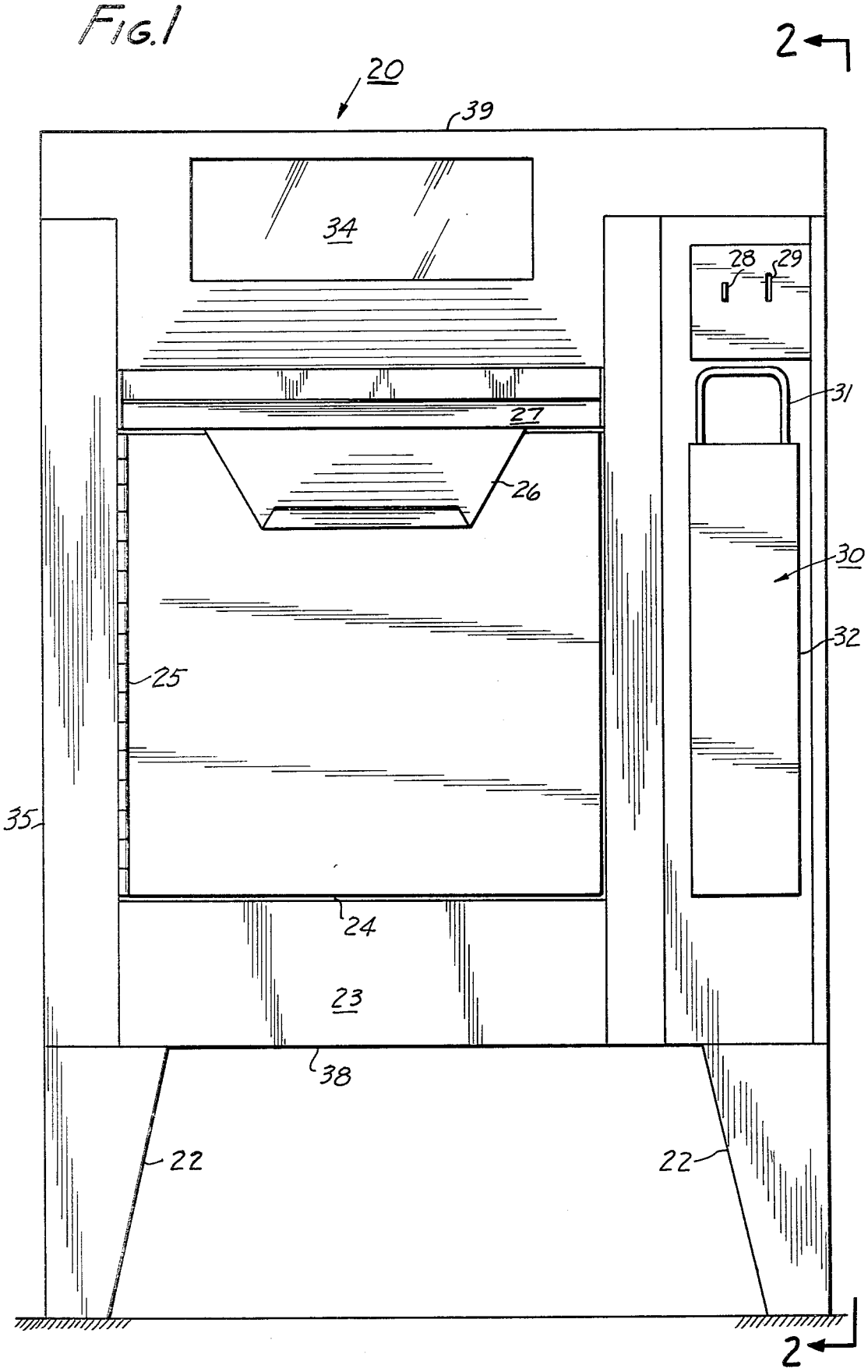
FIG. 1 is a front elevation of a vendor according to the invention.

In FIG. 1 vendor 20 is shown, which is the presently preferred embodiment and the best known mode of practicing the invention. This shows the front elevation as seen by the customer. The vendor includes frame comprising an enclosure 21 having four legs 22, and a front face 23 with a door 24 mounted on a hinge 25. The door can be opened, and can also be held closed by lock means (not shown). An external shelf 26 is provided on the door for catching the dispensed article. The article is issued through a slot 27 in the face of the device. Coin slots 28, 29 are provided to receive coins. An actuating means 30 is hinged to the enclosure. It is a handle having a grip 31 on its free end, and includes a lever arm 32 hinged by hinge 33 at its bottom end. A window 34 gives visual access to a last article yet to be described. This last article will usually be typical of the other articles to be vended by the machine.

Figure 2:
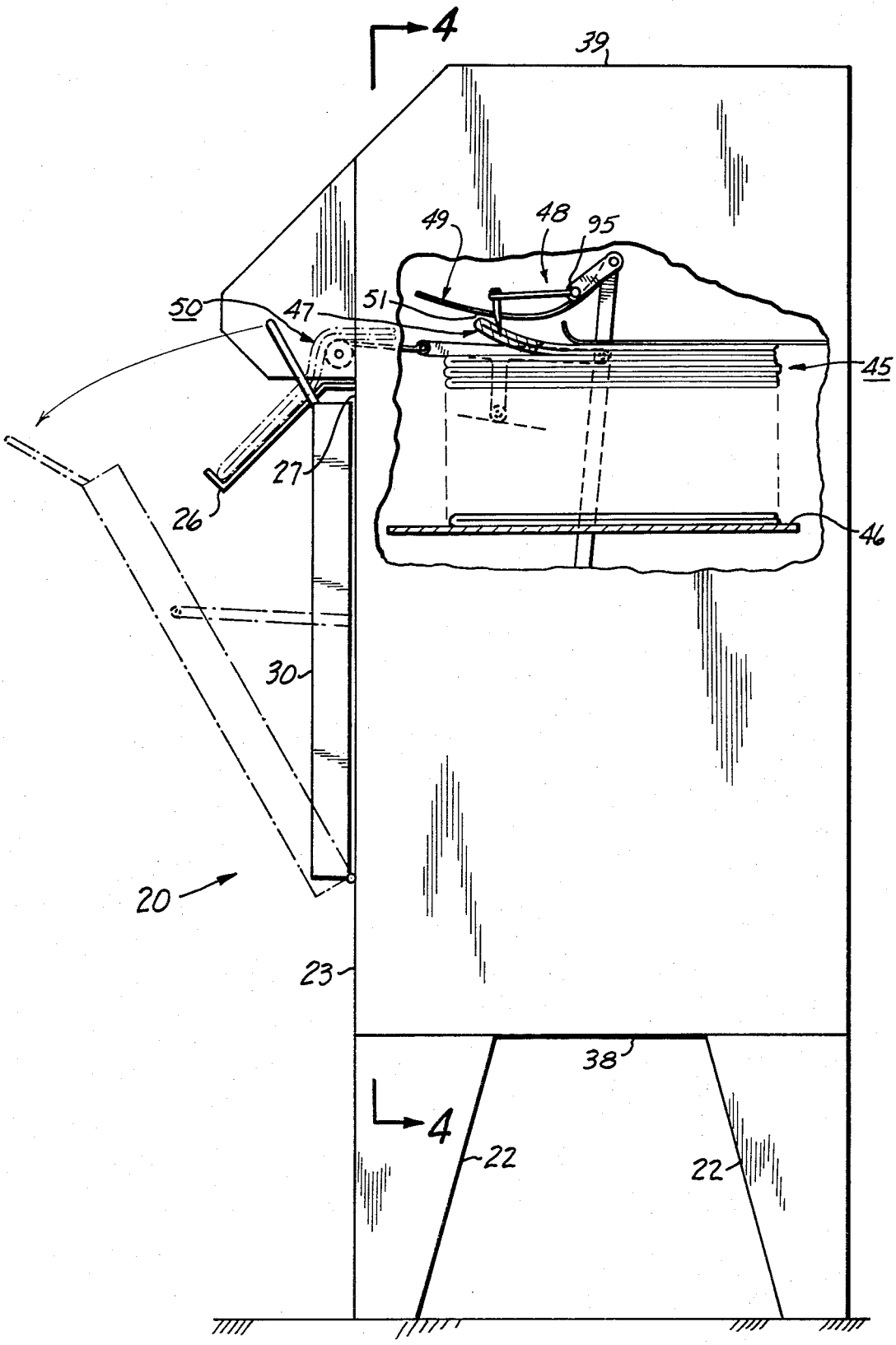
FIG. 2 is a left-hand side elevation with a portion of the cover removed, taken at line 2—2 in FIG. 1.

FIG. 2 is a side-view. Together with FIG. 1 it illustrates side panels 35, 36 and rear panel 37. A bottom 38 and a top 39 complete the enclosure.

This vendor involves the use of several sub-systems which operate in a predetermined order. Some operate before and some operate after the others. Some operate simultaneously with others.

As a brief overview, and with reference to FIG. 2, articles 45 rest on a vertically movable platform 46 with a top article 47 which is next to be issued. The issuance of this article is attained by properly sequenced operation of separator means 48, optional presser means 49, and conveyor means 50.

An interim operating position is shown in FIG. 2 wherein the top article has been pulled upwardly at its forward edge 51. So as to be "separated" from the stack. Separation over the full area of the face is not necessary and the term "separated" is not limited to full-area separation.

The presser means has been moved up out of contact with the article. The conveyor means is about to be drawn to the right underneath the raised edge and beneath the top article, after which the separator means will continue to move upward and the presser means restrains the article to strip it off of the separator means. When the presser means is not used the separator means still will leave the article. At least a portion of the article then lays on the conveyor means. The conveyor means moves to the left to issue the article through the slot. When presser means is used, it holds the article firmly against the conveyor means in a firm grip until the article is released. The necessary sequence is attained by means of a mechanism now to be described in detail. This mechanism will best be understood on a sub-system by sub-system basis.

RELEASE SUB-SYSTEM

Figure 5:
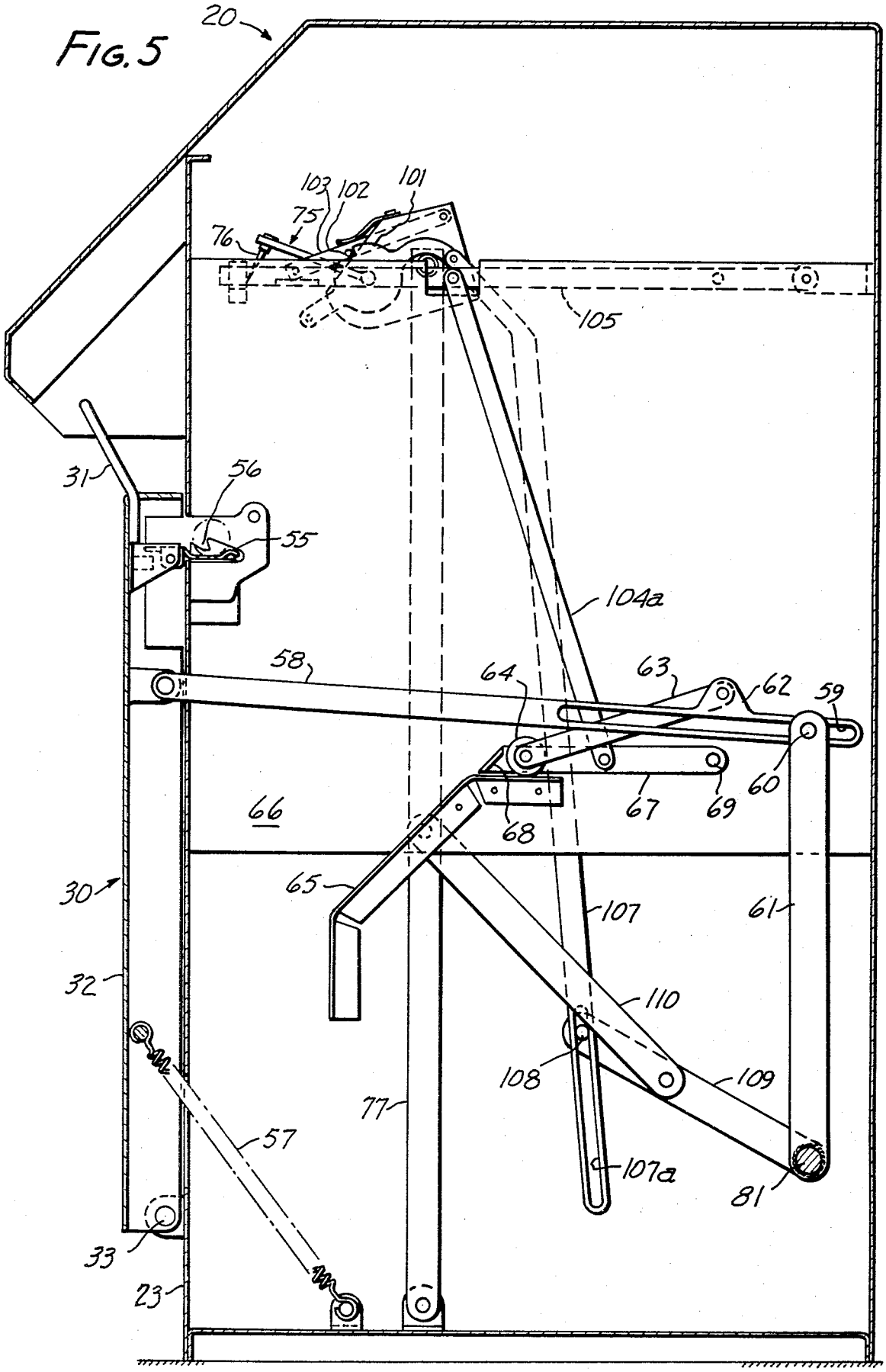
FIG. 5 is a fragmentary side elevation taken at line 5—5 in FIG. 4.

The release sub-system is best shown in FIG. 5, where actuating means 30 is shown held by latch 55 to the front of the enclosure unless and until suitable coinage is inserted through coin slots 28 and 29 to release this latch, thereby to enable the handle to pull to the left in FIG. 5.

FIG. 2 shows the two extreme positions of the handle. The extreme actuated position is shown in coded line, and the latched position in solid line. When the deposit of proper coinage releases latch 55 in coin lock 56, the lever is free to be pulled counterclockwise against the resisting force of bias spring 57. Bias spring 57 is interconnected in tension between the lever and the bottom of the enclosure. The pivoting movement will draw link 58 to the left in FIG. 5.

Attention is called to lost-motion slot 59. A pin 60 on a power transmission link 61 rides in this slot. The link 58 can move to the left or right without moving link 61 within the limits defined by its slot. Flange 62 on line 58 is pinned to an idler link 63 which carries a wheel 64 on its free end. This wheel travels along a track 65 which is mounted to a wall 66 inside the enclosure. A trigger link 67 has a sloped flange 68 on its free end. Its other end is pinned by pin 69 to wall 66 for rotation around the pin. When wheel 64 moves to the left it passes under flange 68 and raises the trigger link. After doing so, it rides along the track, moving down out of the way. When it returns to the right, it rides up over the upper face of flange 68 and again drops to the position illustrated in FIG. 5. Thus, ultimate restraint over the operation of the device is exercised by coin lock 56. Operation of the device is enabled, i.e, triggered, by upward movement of the trigger link which is prevented as long as the lock remains latched. This is the ultimate restraint on the device. The extended length of slot 59 enables the triggering operation to be completed before the manipulation of the article is begun. This completes the description of the release sub-system.

SEPARATOR SUB-SYSTEM

The separator sub-system includes a plurality of article-engaging members 75. In the illustrated embodiment this means comprises a plurality of points 76 which can be driven into a paper article so as to engage and lift ("separate") at least its edge from the stack. These points are supported in a relatively complicated manner which can best be understood from an examination of FIGS. 4, 5 and 7. With initial reference to FIGS. 3 and 5, it will be seen that two support arms 77, 78 ("support means") are mounted by bearings 79, 80, respectively, to the bottom 38 of the enclosure so as to swing to the left and right in FIG. 5. This movement is powered by a compound linkage that derives its actuating power from power transmission link 61. Power transmission link 61 is mounted to a power shaft 81 by tack welding or otherwise. Counterclockwise movement of link 61 caused by link 58 in turn causes counterclockwise rotation of power shaft 81 (FIG. 5). A lift shaft 85 (FIG. 6) is freely pivotally mounted to the upper end of support arms 77 and 78. It will therefore swing with these support arms and can be independently rotated on them. A lift follower 86 includes a lift lever 87 which is pinned to lift shaft 85 and carries a follower wheel 88 at its free end. This follower wheel follows a track 89 which is mounted on the opposite side of wall 66. Track 89 includes an upper rail 90 and a lower rail 91, whereby to give positive guidance to follower wheel 88 in both directions of its movement along the track.

A pair of lift plates 92, 93 are fixed to lift shaft 85 by tack welding or otherwise so as to be rotated by shaft 85 when the shaft is rotated relative to the support arms.

An engagement shaft 95 is journaled in lift plates 92 and 93. The points are mounted to engagement shaft 95 by fingers 96, 97. It will be seen that the position of the points in space is determined by the orientation of the support arms, of lift shaft 85, and of engagement shaft 95.

An arm 99 extends from a latch plate 100 which is also fixed to engagement shaft 95 for rotation therewith. A bias spring 98 biases the latch plate, and therefore engagement shaft 95 in a counterclockwise direction in FIG. 6.

The latch plate includes a latch notch 101 which is engageable by a latch pin 102. In a position yet to be described, latch pin 102 restrains the latch plate to a position where the points are out of contact with an article next to be dispensed. A latch release 103 is mounted to latch arm 104 to which latch pin 102 is also mounted. Arm 104 is mounted to lift plate 92. It will be seen in FIG. 6 that latch pin 102 can prevent the counterclockwise rotation of the latch plate 100, which will restrain the article engaging members.

Trigger-link 67 is connected by link 104*a* to a trigger arm 105 that is pivotally mounted to wall 66. Arm 105 carries a flange 106 which, when link 104*a* is moved upward as a consequence of follower wheel 64 passing beneath flange 68, causes flange 106 to move latch release 103 upward. This pulls latch pin 102 out of latch 101. Bias spring 98 then turns the latch plate and the engagement shaft to press the points against the top article in the stack, thereby to engage the article. This action can occur only when the mechanism is at the start of its stroke as shown in FIG. 5.

Figure 6:
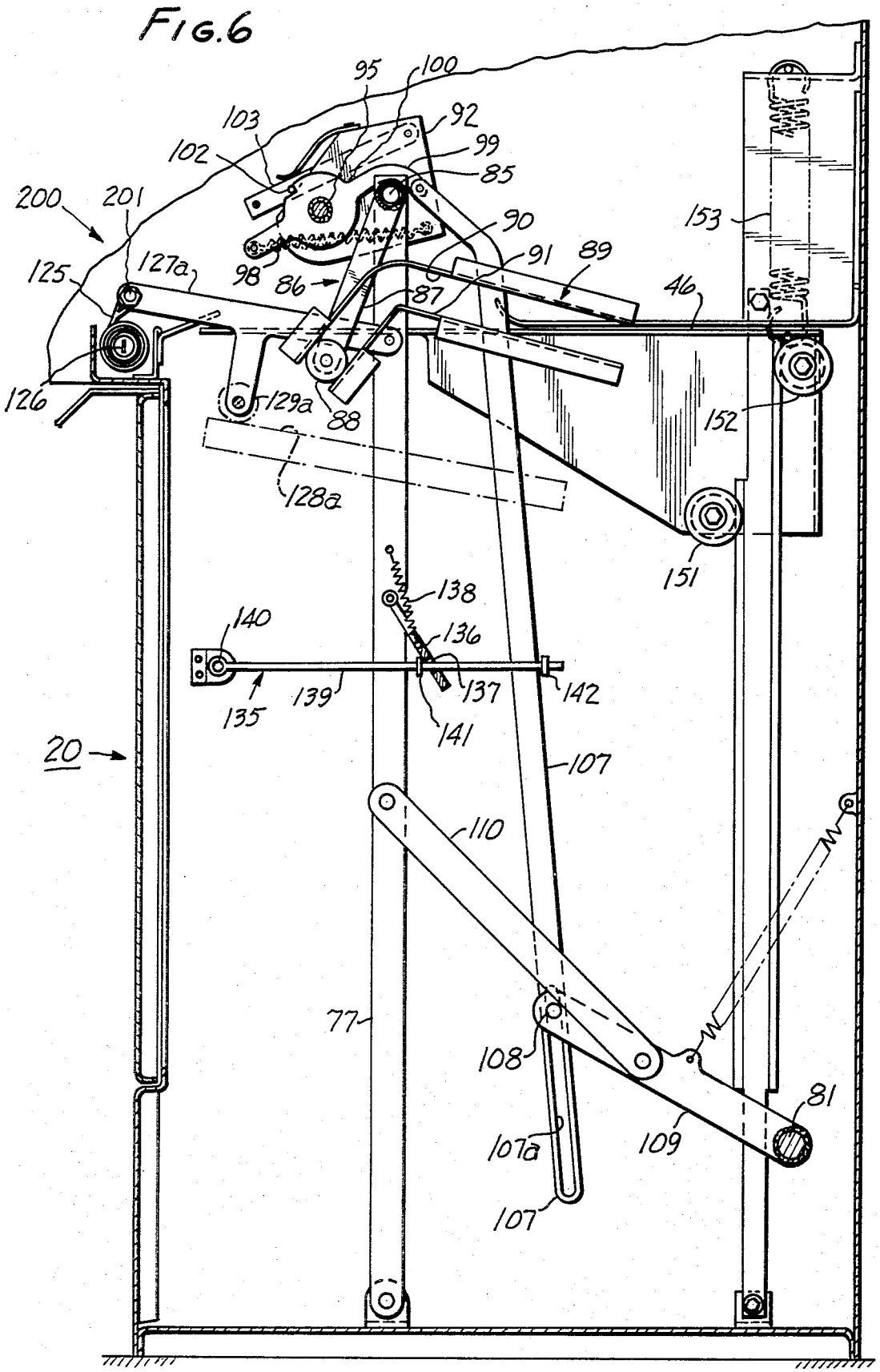
FIG. 6 is a cross-section taken at line 6—6 in FIG. 4.

A coordinator link 107 includes a slot 107*a* (see FIGS. 5 and 6). A pin 108 rides in slot 107. Pin 108 is mounted to power lever 109. Power lever 109 is tack welded or otherwise fixed to shaft 81. It is pivotally joined to a second power lever 110, which in turn is pivotally joined to support arm 77.

Rotation of power shaft 81 will cause swinging movement of the support arms. It will also cause the pin 108 to move up and down in slot 107. This latter movement has no effect on link 107 at the position shown in FIGS. 5 and 6, but farther along in the operation, pin 108 bears against the bottom of the slot, and will thereafter cause downward movement of coordinator link 107. This will rotate latch plate 99 independently of the position of the lift lever 87. When the support means have reached their rearward most position, this will rotate latch plate 99 to the position of FIG. 6 (relative to the lift plate), and shaft 95 the article engaging means will be turned to their second position where there is no engagement with an article. Their "first" position is in engagement with an article.

Accordingly, the separator sub-system comprises a means which can lock the article engaging members in a position where they cannot contact the article subject to release only after adequate coinage has been released, followed by release of the points to engage the article, followed by a rotation of the lift plate with the points engaged to raise (separate) the edge of the article, followed by retraction and latching of the article engaging means, followed by a return to the position shown in FIGS. 5 and 6. These are coordinated by track 89 and by the coordinator link 107.

PRESSER SUB-SYSTEM (OPTIONAL)

Figure 7:
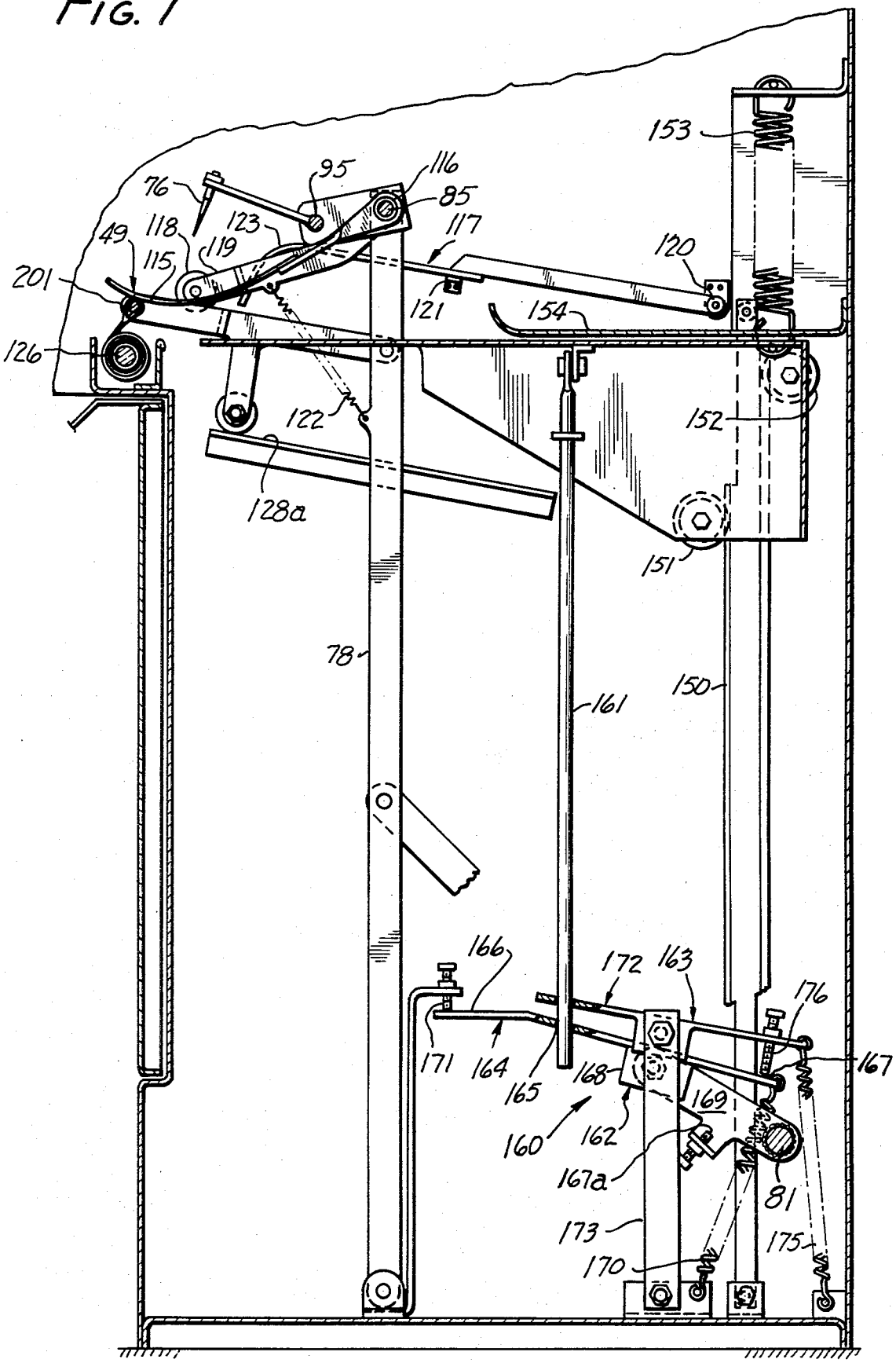
FIG. 7 is a fragmentary cross-section taken at compound section line 7—7 in FIG. 4.

The presser sub-system has as its intended function the movement of presser means 49 which comprise a plurality of presser fingers 115 (FIG. 7). These are movable around a presser shaft 116 which is coaxial with and surrounds lift shaft 85. The orientation is partially defined by track 117 mounted to side wall 35 of the enclosure. A follower arm 119 is pinned to presser shaft 116 and carries a follower wheel 118. The track is pivotally mounted to wall 35 by hinge pin 120. A support flange 121 on the wall defines the lowermost position of the track. It can be pivoted up (clockwise) by the follower wheel. A bias spring 122 is in tension between support arm 78 and follower arm 119, which biases the fingers toward the article, and the follower arm toward flange 121.

The fingers are pressed down at the start of operation (FIG. 7). When the support arms move clockwise, follower wheel 118 engages the upper surface 123 of track 117 and climbs it. This retracts the presser fingers. The track holds them retracted until the follower wheel passes the rear edge 124 of the track. Then the wheel falls off the track, and the presser fingers are pressed against the top of the article by bias spring 122.

When the support arms move counterclockwise to issue the article, follower wheel 118 passes beneath the track, bumps it up as it passes beneath it, and resumes the position of FIG. 7. The presser fingers therefore press against the article throughout the ejection movement. This is an optional function, but does provide a positive grip which makes more reliable the expulsion of the article. However, the article can be carried out by the conveyor means alone, if it is inserted far enough under it, and if its surface area is sufficient to support and carry it out.

Also, the pressure means aids in stripping the article off of the article-engaging means. However, the article can be expected to fall off of the points when they are retracted. Therefore, this function of the presser means is also optional.

UNIDIRECTIONAL LOCK SUB-SYSTEM

In FIG. 6 there is shown a unidirectional lock 135 which prevents reversal of operation in the middle of a cycle. It permits the support arms to swing first clockwise and then counterclockwise, but does not permit the reversal until after the full cycle is concluded.

A latch plate 136 with a slot 137 therein is pivotally mounted to support arm 77. It can move over center as a toggle. A bias spring 138 keeps the latch plate on one side or the other of center until the latch plate is pushed over center.

A lock shaft 139 is cylindrical, and is hinge-mounted to the enclosure by hinge pin 140. It carries a pair of limit stops 141, 142, which reverse the position of the latch plate. In FIG. 6, the position of the latch plate has just been reversed and the device is at rest awaiting the next cycle. The latch plate can slide to the right along the lock shaft in its illustrated position, but not to the left. Sliding to the left would cause the edges of the slot to bite into the shaft and actually try to bend the lock shaft. Therefore it is unidirectional. After limit stop 142 is struck and the latch plate snapped over center, the situation is reversed.

CONVEYOR SUB-SYSTEM

The Conveyor Sub-System ("conveyor means") comprises an element which can be brought underneath the raised edge of the top article, and when the top article is dropped onto it, the element will carry the top article away from the stack. In the preferred embodiment of the invention, this element has a large sheet-like surface which supports the article sufficiently that it is carried smoothly away by the element, even without the use of the presser sub-system. However, it is not necessary that so large an area be provided. Instead, it could be a relatively small bar or support beneath the top article, used with the presser means to form a grip on the article to grip and eject it.

Figure 8:
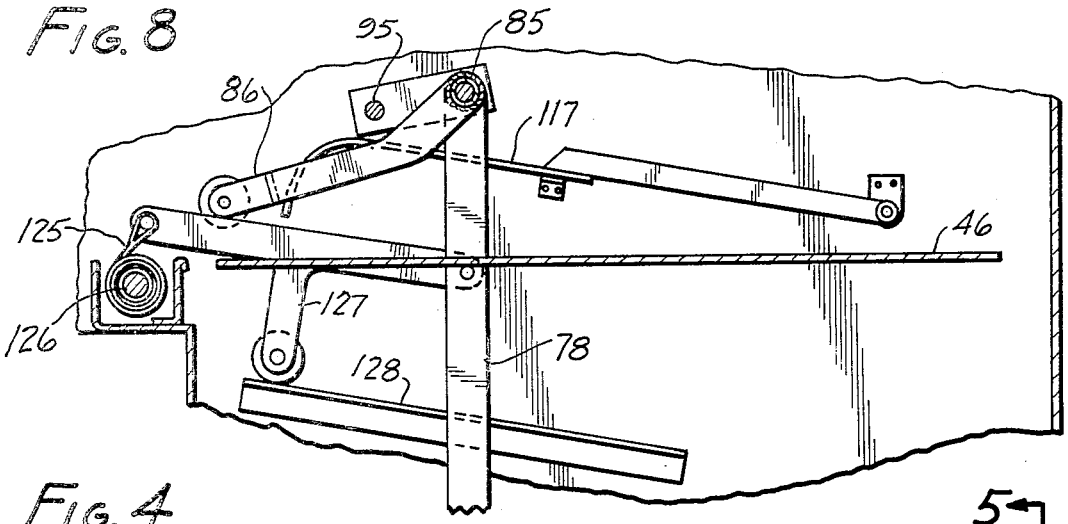
FIG. 8 is a fragmentary section taken at line 8—8 in FIG. 4.

In the preferred embodiment as illustrated (see FIGS. 3, 6, 8 and 11) the conveyor means 200 includes a cross-bar 201 which is brought beneath the raised edge of the top article. To accomplish this objective, it is supported by puller links 127, **127*a* (FIGS. 6 and 8) which are pinned to support arms 77 and 78. Tracks 128 and 128*a* support and guide wheels 129 and 129*a* to guide the path of the cross-bar. When the support arms swing to the right in FIGS. 2 and 6**, the cross-bar is moved beneath at least the top edge of the top most article, which edge has been "separated" or "lifted" from the article next beneath it. When the support arms return, the top article will have been dropped on to the cross-bar, and it will carry the top article off the stack.

If the cross-bar is wide enough, it can do the conveying task by itself. However, that might require a greater thickness of enclosure than is desired. Accordingly, a convenient means for "enlarging" the conveyor means is a flexible sheet 125 in the nature of a roller shade wound on a spring-loaded roller 126. The free end of the sheet is wrapped around the cross-bar, and moves with it. The movement of the cross-bar to the right unrolls the sheet and draws it under the top article. The spring load in shaft 126 rewinds the sheet when the cross-bar returns. Thus, the flexible sheet forms an optional part of the conveyor means.

As previously stated, the presser means can work with the conveyor means, and enable a small element to be used for a conveyor means such as the cross-bar by itself. This can be seen in FIG. 11, where the presser fingers 115 are shown pressing the article against cross-bar 201, the two parts acting as a clamp or grip to seize and carry the article away from the stack when the support arms move to the left. In this situation, the flexible sheet 125 is actually optional. However, it is useful and causes the article to be carefully guided and gently handled.

PLATFORM SUB-SYSTEM

Platform 46 is supported on a pair of vertical guides 150 by wheels 151 and 152. It is biased upwardly by a spring 153 which tends to pull the platform and whatever is on it upwardly toward a limit plate 154 which determines the upper elevation of the stack. The top article is pressed against the limit plate. The weight of articles on the platform will weight the platform down. The bias spring is strong enough to pull the loaded platform up so that the top of stack presses against the limit plate. In order to prevent such a strong binding force from being exerted that the article could not be issued, means is provided to relieve the stack from the limit plate during each actuation when the top article is to be released.

This is accomplished by a stack manipulation means 160 which is best shown in FIG. 7. A grip shaft 161 is fixed to and depends downwardly from the platform. It passes through a pair of limit locks 162 and 163 each of which is capable of both holding and passing the grip shaft.

The condition illustrated in FIG. 7 is a full relaxation of both locks. The platform can be raised by spring 153 so the top article presses against limit plate 154. Thereafter, the scheme of operation is to relieve the pressure against the limit plate by lowering the platform while the conveyor means is being inserted, and while the top article is removed, and then to release the platform again to press the next article against the limit plate. Thus, the vendor can handle articles of any thickness without adjustment, and even intermixed articles of different thickness.

Limit lock 162 is used to pull the platform down against the resistance of bias spring 153. It includes a plate 164 with a slot 165, and contact portions 166 and 167. It has a flange 168 which is pivotally joined to an actuating lever 169 that is tack welded or otherwise fixed to power shaft 81. Bias spring 170 is held in tension between contact portion 167 and the bottom of the enclosure. When shaft 81 is turned counterclockwise, the effect of bias spring 170 is to cause slot 165 to bind on shaft 161 and pull it down. Stop 171 limits the position of contact portion 166 until contact portion 167 strikes limit pin 167*a*. When this contact occurs, portion 166 leaves stop 171, because pivot 168 continues to turn. However, this releases the pulling action at 165 and stops the downward movement of the platform. The platform is now held down by limit lock 163.

Limit lock 163 includes a plate 172 which is pivoted to a standard 173. It is biased by bias spring 175 to move a limit stop 176 toward contact portion 167. It passes the grip shaft on its way down, but locks it against upward movement until contact portion 167 is returned by reverse movement of shaft 81 to strike limit stop 176. This upsets plate 172 and enables the grip shaft again to move upwardly. Limit lock 162 already permits it.

LAST ARTICLE DELIVERY SUB-SYSTEM

Figure 9:
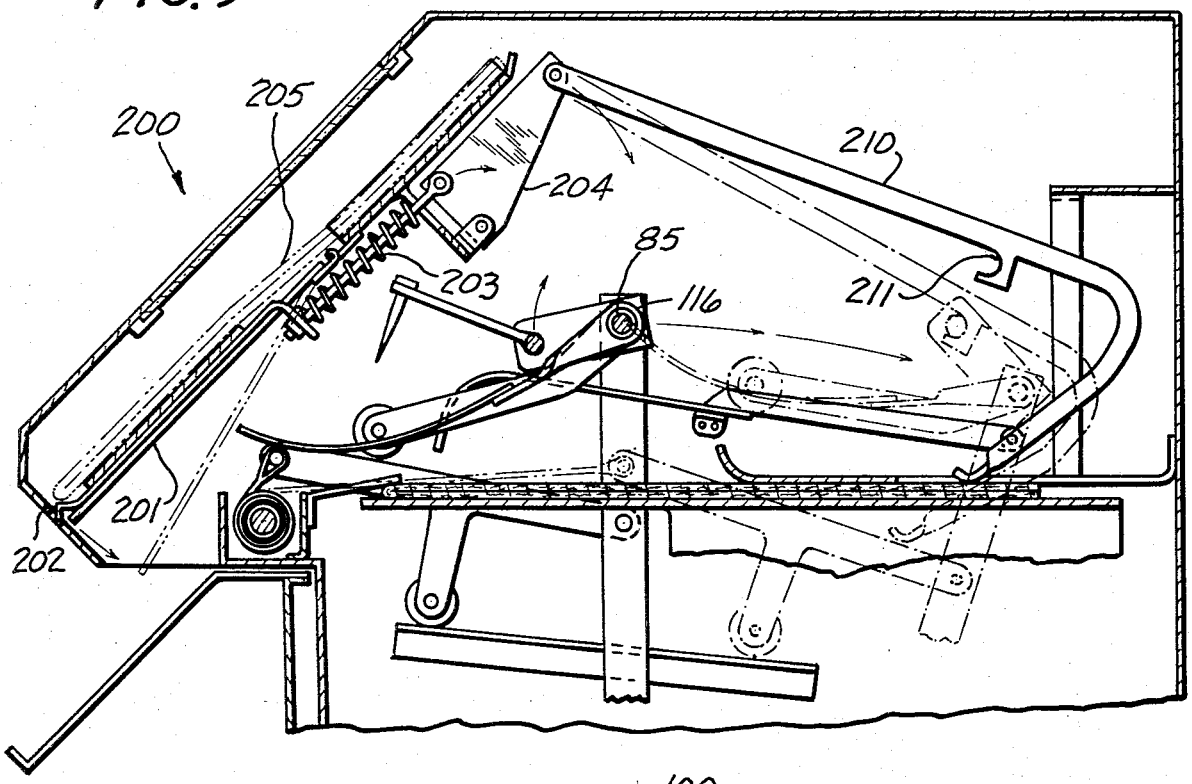
FIG. 9 is a fragmentary cross-section taken at line 9—9 in FIG. 4.

The last article delivery sub-system 200 is shown in FIG. 9. A lower trap door 201 is held closed by a latch 202. The latch is spring-loaded closed by spring 203. A bell crank 204 is hinge mounted to the enclosure, and latch 202 is attached to it to slide it for release or latching. Release of the latch will permit the weight of a last article 205 to open door 201 and drop onto shelf 26.

Figure 3:
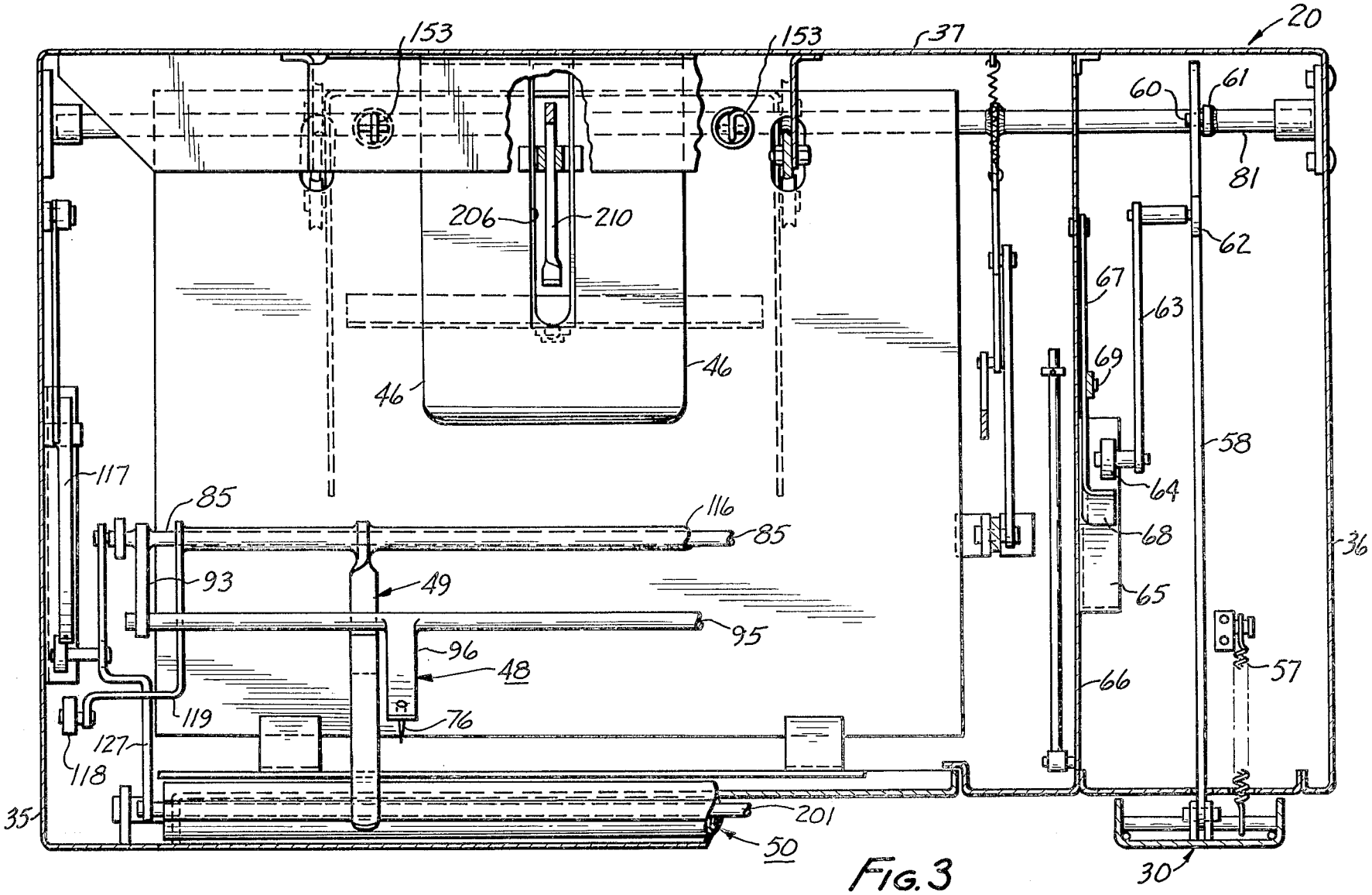
FIG. 3 is a top view taken at compound section line 3—3 in FIG. 4.
Figure 4:
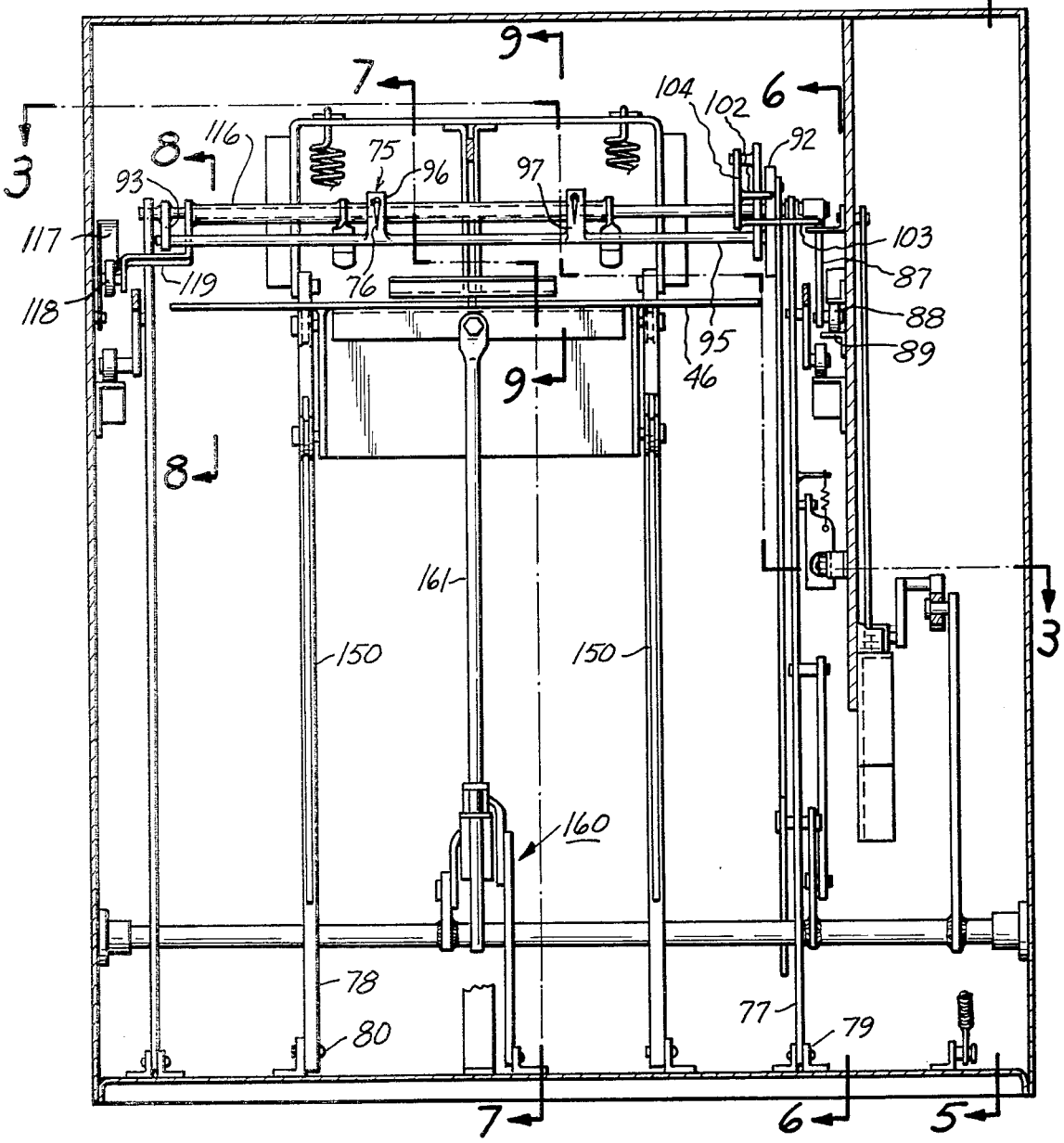
FIG. 4 is a side elevation taken at line 4—4 in FIG. 2.

Platform 46 has a slot 206 therethrough which is covered by any article on the platform. As shown in FIGS. 3 and 9, a trip arm 210 is pivotally mounted to latch plate 204. It assumes the solid line position when it rests on a top article on the platform. It assumes the lower coded line position when it falls through slot 206. When in this latter position, a latch 211 can intercept shaft 116, which will pull the trip arm and the latch plate to release the latch when there is no article on the platform.

This concludes the disclosure of the sub-systems. The coordination of these sub-systems to protect the stack of articles and to deliver one article at a time will now be described.

OPERATION OF THE SYSTEM

Figure 10:
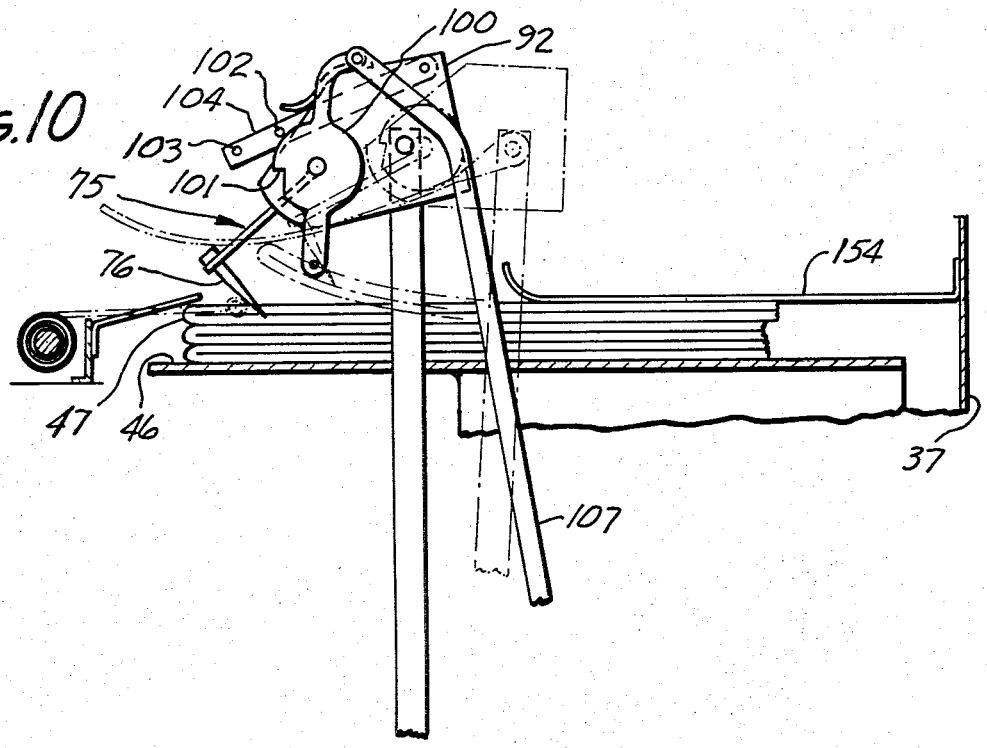
FIG. 10 is a fragmentary elevation showing another operational position of the device.

It will be assumed that the device is in the at rest position shown in FIGS. 5, 6 and 7. As a consequence of the last cycle, the platform will have raised the stack of papers until the top article bears against the underside of limit plate 154, as best shown in FIG. 10. For convenience in illustration, articles to be dispensed are not shown in FIGS. 5, 6 and 7. In the "at rest" condition, lever arm 32 is closest to the front of the enclosure and is held locked to it by latch 55. When suitable coinage is supplied, this latch is released and then the handle can be pulled to the left in FIG. 5 so it pivots counterclockwise around pivot 33 against the restraining force of spring 57. This pulls draw link 58 to the left as best seen in FIG. 5. Initial movement of the link will not cause any internal reaction, because some ease and tolerances are desirable. However, after some amount of movement, and before pin 60 bottoms out in lost motion slot 59, idler link 63 has moved its wheel underneath trigger link 67. This causes the flange 68 to move upwardly which shoves link 104*a* against trigger arm 105. Upward movement of trigger arm 105 moves latch release 103 upward pulling latch pin 102 out of latch 101. This permits bias spring 98 to turn the latch plate and the engagement shaft to press the points ("article engaging means") against the top article in the stack, thereby to engage the top article. This causes the condition shown in FIGS. 2 and 10 and the folded edge of the article can now be peeled upwardly i.e., separated from the next member of the stack below in order for the conveyor to be brought in underneath it. The support arms cause the article engaging means to "traverse" i.e., travel across the end article, and there is also some rotation of them, all as will be seen.

Figure 11:
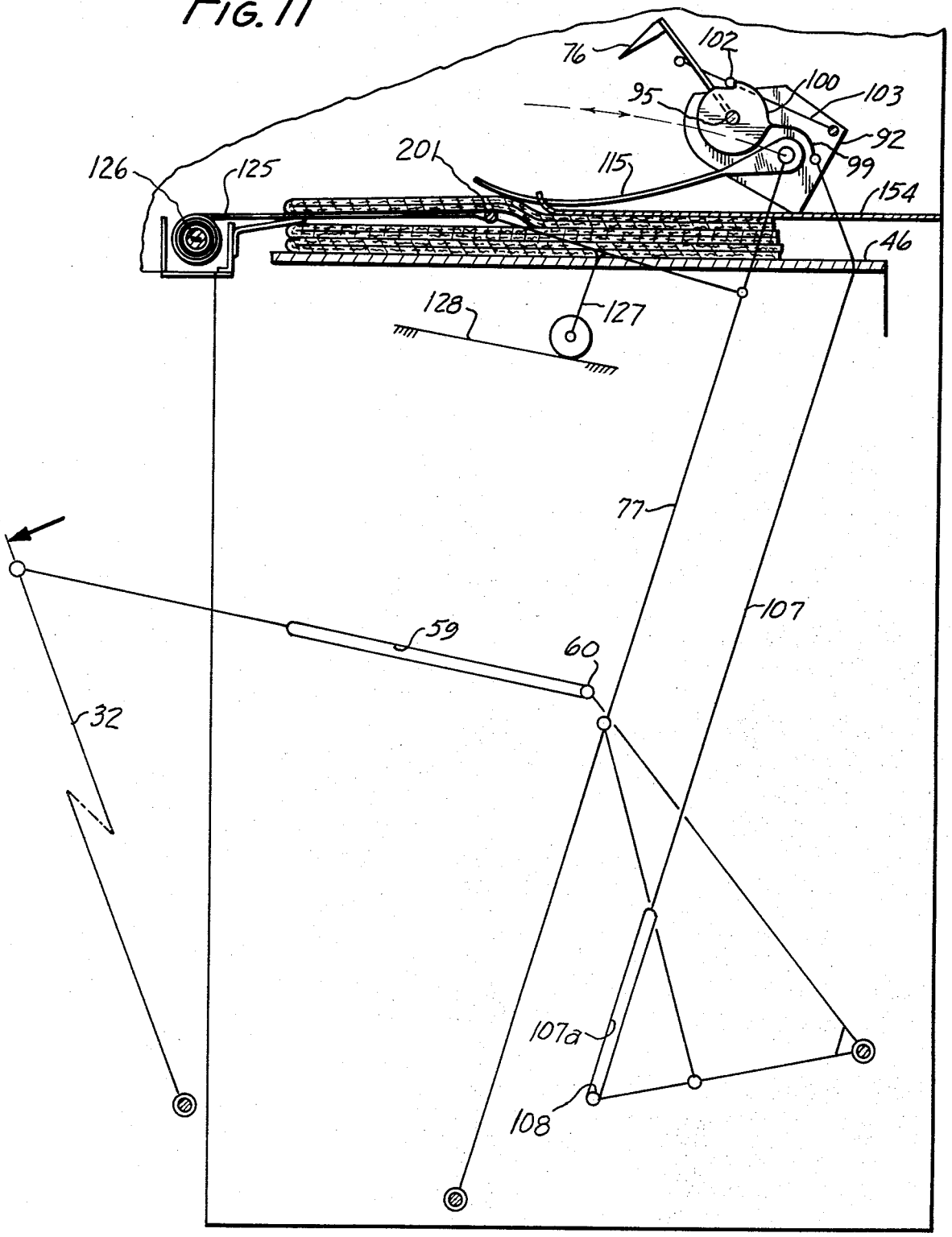
FIG. 11 is a semi-schematic cross-section showing still another position of operation of the device.

Further movement of the system is caused by the bottoming out of slot 59 on pin 60 which rotates link 61 and shaft 81. For a time this has no effect on coordinator link 107 because pin 108 simply rides in slot 107. However, power lever 109 as it rotates pulls down second power lever 110 which is mounted to support arm 77 and 78. Therefore, continuing the pull on the actuating handle will cause the support arms to swing toward the rear of the enclosure and will thereby move the assemblies attached to it in that arc the effect of which is to begin a "peeling" action of the article. As has later been described, pin 108 will bottom out in slot 107*a* and then cause downward movement of coordinator link 107 (FIG. 11). Continuing "peeling" is also caused by the guidance given by tracks 89 to follower wheel 88 which cause rotation of shaft 85 to which lift plates 92 and 93 are fixed. Rotation of these two plates carry with it shaft 95 and therefore the article engaging means as a unit. Accordingly, the position of that unit is determined by the location of support arms 77 and 78 and this is a means of coordinating the same.

It is sufficient for purposes of this invention to provide only the article-engaging members and the conveyor member. However, greater certainty of operation is achieved if the presser sub-system is also used. The presser fingers are moved by a presser shaft 116 which is coaxial with and movable with lift shaft 85. As has been previously described, its position is determined by the travel of a follower wheel 118 on track 117. When the support arms move toward the rear far enough it is desired for the points to be withdrawn from the article. As a practical matter toward the rear, the article will ordinarily simply fall off the points. However, the presser fingers are present as shown to act as stripper means serving to restrain the article as the points are withdrawn farther. Near the end of that movement, the follower wheel 118 falls off the top of track 117 which permits the presser fingers to go down against the article, and when the device swings again toward the front of the cabinet, the wheel is underneath the track so it cannot be lifted by it and the presser fingers serve as a presser means making a firm pressure on the top of the article to hold it against the conveyor means which has been drawn underneath the upper article. Finally the wheel lifts the track to pass under it. As can best be seen in FIGS. 2 and 9 swinging the support arms toward the rear of the cabinet will draw the conveyor means under the top article with its elevation being maintained by rolling action of follower wheel 129 along track 128.

When the support arms are closest to the rear of the enclosure (FIG. 11), then pin 108 will have bottomed out in slot 107*a*, and pulled coordinator link 107 downward which will rotate the latch-plate so that engagement of the latch-pin in the latch slot will recur. This is at the farthest-out position of arm 32. When the handle is released, the bias forces in the system will cause the support arms to move toward the front of the enclosure, and the conveyor will carry the article out the slot. The presser is not necessary for this function but when it is used it makes a more reliable grip on the article causing it to be carried out the slot. During the return action, the article engaging means will again have been restrained by the latch-pin and when the handle returns to the lock it is held thereby preventing another cycle until adequate coinage has been inserted.

It will be seen from the foregoing that the sub-systems are operated by the power shaft and the bias means, and are coordinated largely by reaction with track means held to the cabinet itself. Each sub-system operates in its predetermined sequence, also partly because of the lost-motion slots. The release sub-system holds the system against any operation until coinage is inserted. Thereafter, the system is unlatched and the article engagement means are engaged to an article. The system then moves such that the article engaging means lift and separate the article from the stack, the presser means when used are first held back and then allowed to press against the top article, but only as permitted to press against it after the conveyor means has been inserted under the edge of the top article. Then the conveyor carries the article out of the slot. It will also be observed that the platform is eased downwardly a trifle during this operation but then is moved up to bring the article against the limit plate for the next cycle so that everything in the system is determinable from a single level.

The last article mechanism operates as has been previously described when there is no article atop the platform to hold trip arm 210 upwardly.

The term "platform" is intended to have a broader connotation than merely a support from below. It is evident that this is the best way for dispensing articles because the free edge of the article can be made available to engagement means most readily. However, side feeding or feeding of articles from a shingled stack at an angle are all regarded as within the scope of the term "platform". The term platform therefore means any structure which gives support to the stack and tends to move it toward a limit plate at which the described manipulations can take place.

This invention will thereby be seen to be an elegantly simple device for dispensing one article at a time from the top of a stack.

This invention is not to be limited by the embodiment shown in the drawings and described in the description which is given by way of illustration and not of limitation, but only in accordance with the scope of the appended claims.

I claim:

1. A vendor for dispensing a single flexible, substantially flat article at a time from a stack of said articles, comprising:

a frame;

a platform on said frame for supporting a stack of articles from which an end article is to be dispensed;

separator means comprising an article engaging member movable to a first position in engagement with said end article, and to a second position not in engagement therewith;

release means comprising latch means for holding said article engaging member in said second position, and means for releasing said article engaging member to move to said first position;

support means mounted to said frame supporting said article engaging means for traverse movement relative to said end article and for rotation relative thereto for lifting an edge of said end article in a peeling type movement from said edge while said article engaging member is in said first position;

conveyor means mounted to said frame and insertable beneath the lifted edge of said end article while part of said article rests on the article next beneath it in the stack, thereafter to convey said end article away from the stack after the article is released by the article-engaging means; and actuator means mounted to said frame which, when permitted to function, releases said latch means to enable the article engaging member to engage said end article adjacent to said edge, move the support means to cause the article engaging member to lift said edge in a peeling-type movement, move the conveyor means past said edge and underneath at least a part of the end article, release the article from said article engaging member, and move the conveyor means with the end article away from the stack.

2. A vendor according to claim 1 in which the frame includes an enclosure for enclosing the stack, said enclosure having an opening through which the said article is made available.

3. A vendor according to claim 1 in which said actuator means comprises a lever, said lever being adapted to be disabled or prevented from movement by coin-actuated means until after coinage of at least a predetermined amount have been supplied.

4. A vendor according to claim 1 in which said support means comprises an arm pivoted to said frame, said separator means being mounted to said support means at a location spaced from the point where the support means is mounted to the frame, said separator means including a lift plate pivotally mounted to said support arm, said article engaging means being pivotally mounted to said lift plate, bias means biasing said article engaging means toward the said end article, said latch means being interposed between said lift plate and said article engaging means, and being mounted to said lift plate, and follower means for rotating said lift plate.

5. A vendor according to claim 4 in which said latch means includes a latch release actuable by the actuator means to release the article engaging means to assume its first position, and a coordinator link also actuated by said actuator means to return the article-engaging means to its second position and latch it in said second position after the edge of the article has been lifted and the conveyor means is inserted beneath it.

6. A vendor according to claim 5 in which said latch means includes trip means moved by said actuator means to release said article-engaging means from said second position.

7. A vendor according to claim 5 in which said conveyor means comprises a flexible member wound on a shaft adjacent to the stack, the said flexible member being drawn off the said shaft and beneath the raised edge of the end article by movement of the support means.

8. A vendor according to claim 7 in which a track is mounted to said frame for guiding and supporting an end of said flexible member.

9. A vendor according to claim 1 in which said conveyor means comprises a flexible member wound on a shaft adacent to the stack, the said flexible member being drawn off said shaft and beneath the raised edge of the end article by movement of the support means.

10. A vendor according to claim 1 in which a unidirectional lock is disposed between the frame and the support means to prevent reversal of operation of the vendor until after the conveyor means has been inserted beneath the said end article.

11. A vendor according to claim 1 in which the platform moves vertically, and in which a limit plate overhangs it to limit the height to which the platform can move the top of the stack, and in which means is provided for lowering the stack to free the end article after the article-engaging means has lifted said edge of the end article.

12. A vendor according to claim 1 in which presser means is provided to hold said end article against the conveyor means.

13. A vendor according to claim 12 in which said presser means comprises a finger pivotally mounted to support means, and follower means to determine its angular position relative to the support means.

14. A vendor according to claim 13 in which said follower means includes a track mounted to the frame, said follower following said track.

15. A vendor according to claim 1 further including last article delivery means, said last article delivery means comprising a compartment with a latched door, said compartment for containing an article to be dispensed only when there is no article on the platform, said platform having an aperture so disposed and arranged as to be covered by an article atop it, the said last article delivery means having a trip arm which maintains the door latched closed as a consequence of resting on an article on the platform, and unlatching the door by moving through said aperture when there is not article on the platform, said unlatching being caused by engagement with the support means during the article-dispensing operation.

16. A vendor according to claim 12 in which said support means comprises an arm pivoted to said frame, said separator means being mounted to said support means at a location spaced from the point where the support means is mounted to the frame, said separator means including a lift plate pivotally mounted to said support arm, said article engaging means being pivotally mounted to said lift plate, bias means biasing said article engaging means toward the said end article, said latch means being interposed between said lift plate and said article engaging means, and being mounted to said lift plate, and follower means for rotating said lift plate.

17. A vendor according to claim 16 in which said presser means comprises a finger pivotally mounted to support means, and follower means to determine its angular position relative to the support means.

18. A vendor according to claim 16 in which said latch means includes a latch release actuable by the actuator means to release the article engaging means to assume its first position, and a coordinator link also actuated by said actuator means to return the article-engaging means to its second position and latch it in said second position after the edge of the article has been lifted and the conveyor means is inserted beneath it.

19. A vendor according to claim 18 in which said latch means includes trip means moved by said actuator means to release said article-engaging means from said second position.

20. A vendor according to claim 19 in which said conveyor means comprises a flexible member wound on a shaft adjacent to the stack, the said flexible member being drawn off the said shaft and beneath the raised edge of the end article by movement of the support means.

21. A vendor according to claim 20 in which a track is mounted to said frame for guiding and supporting an end of said flexible member.

22. A vendor according to claim 16 in which the platform moves vertically, and in which a limit plate overhangs it to limit the height to which the platform can move the top of the stack, and in which means is provided for lowering the stack to free the end article after the article-engaging means has lifted said edge of the end article.

23. A vendor according to claim 18 in which the platform moves vertically, and in which a limit plate overhangs it to limit the height to which the platform can move the top of the stack, and in which means is provided for lowering the stack to free the end article after the article-engaging means has lifted said edge of the end article.

24. A vendor according to claim 22 further including last article delivery means, said last article delivery means comprising a compartment with a latched door, said compartment for containing an article to be dispensed only when there is no article on the platform, said platform having an aperture so disposed and arranged as to be covered by an article atop it, the said last article delivery means having a trip arm which maintains the door latched closed as a consequence of resting on an article on the platform, and unlatching the door by moving through said aperture when there is no article on the platform, said unlatching being caused by engagement with the support means during the article-dispensing operation.

25. A method of dispensing a single flexible, substantially flat article at a time from a stack of said articles, said articles each comprising a plurality of flat abutting flexible sheets and having a folded or magazine-like edge, said articles lying one atop another with their said edges in alignment, said method comprising:

engaging the end article of said stack near its said edge and bending it to separate its said edge from the stack by lifting said edge and thereby exposing the under surface of said end article adjacent to said edge, in a peeling movement while imparting only a single bend to said article;

laterally relative to said stack inserting a conveyor means beneath said raised edge and part of said exposed under surface while part of said article continues to rest atop the article next beneath it in the stack, and then lowering at least a part of said exposed under surface onto the conveyor means and releasing said engagement so that said part of said under surface is separated from said stack and supported by said conveyor means; and laterally moving the conveyor means with said end article on it laterally away from the top of the stack in a shear-like movement relative to the top of said stack.

26. A method according to claim 25 in which pressor means presses the article against the conveyor means while the conveyor means moves the article from the stack.

27. A method according to claim 26 in which the stack is supported by a movable platform, the limit of movement of the stack being defined by a limit plate, and in which the platform is lowered during movement of the said end article off the stack.

* * * * *